US012649545B2

(12) United States Patent
Oswell

(10) Patent No.: US 12,649,545 B2
(45) Date of Patent: Jun. 9, 2026

(54) COMPACTIBLE HELM STATION FOR A MARINE VESSEL

(71) Applicant: ROSWELL CANADA INC., Acheson (CA)

(72) Inventor: Robert E. Oswell, Merritt Island, FL (US)

(73) Assignee: ROSWELL CANADA INC., Acheson (CA)

( * ) Notice: Subject to any disclaimer, the term of this patent is extended or adjusted under 35 U.S.C. 154(b) by 592 days.

(21) Appl. No.: 18/126,548

(22) Filed: Mar. 27, 2023

(65) Prior Publication Data

US 2023/0322329 A1 Oct. 12, 2023

Related U.S. Application Data

(60) Provisional application No. 63/323,570, filed on Mar. 25, 2022.

(51) Int. Cl.
*B63B 15/00* (2006.01)
*B63B 17/02* (2006.01)
*B63B 29/04* (2006.01)

(52) U.S. Cl.
CPC ..... *B63B 15/00* (2013.01); *B63B 17/02* (2013.01); *B63B 29/04* (2013.01); *B63B 2017/026* (2013.01); *B63B 2029/043* (2013.01)

(58) Field of Classification Search
CPC ..... B63B 15/00; B63B 17/00; B63B 17/02; B63B 29/00; B63B 29/04; B63B 2029/043; B63B 2017/026
USPC ..... 114/343, 361, 364
See application file for complete search history.

(56) References Cited

U.S. PATENT DOCUMENTS

| | | | | |
|---|---|---|---|---|
| 3,325,836 | A | 6/1967 | Lankford, Jr. | |
| 3,805,724 | A | 4/1974 | Butler | |
| 4,955,313 | A | 9/1990 | Terry, III | |
| 6,357,379 | B1 | 3/2002 | Murphy, Jr. | |
| 6,860,222 | B2 | 3/2005 | Himmel | |
| 6,883,456 | B1 | 4/2005 | Hickok | |
| 6,988,461 | B1 | 1/2006 | James | |
| 7,143,363 | B1 * | 11/2006 | Gaynor | B63B 79/40 440/84 |
| 7,159,531 | B2 | 1/2007 | Baylor | |

(Continued)

OTHER PUBLICATIONS

Action Welding & Marine Fabrication, downloaded from Internet Jun. 21, 2023, 7 pages https://actionweld.com/photo-galleries/t-towers-crows-nest/crows-nest/.

(Continued)

*Primary Examiner* — Lars A Olson
(74) *Attorney, Agent, or Firm* — Timothy H. Van Dyke; Wolter Van Dyke Davis, PLLC

(57) ABSTRACT

An apparatus (100), including: a lower structure (122) configured to be a top of a lower area (102) of a marine vessel (130); and an upper structure (120) configured to be raised and lowered relative to the lower structure. When the apparatus is in a stowed configuration the lower structure and the upper structure combine to form an integrated top (124) for the lower area. When the apparatus is in a raised configuration the apparatus creates an occupant station (400) in which the lower structure is the top of the lower area and also a floor for an occupant station and the upper structure acts as a top for the occupant station.

19 Claims, 19 Drawing Sheets

(56) References Cited

U.S. PATENT DOCUMENTS

| | | | |
|---|---|---|---|
| 7,654,216 | B2 | 2/2010 | Grieger |
| 9,038,875 | B2 | 5/2015 | Jesewitz |
| 2003/0217683 | A1 | 11/2003 | Heckman |
| 2013/0319310 | A1 | 12/2013 | Harbin |
| 2014/0109816 | A1 | 4/2014 | Raiter et al. |

OTHER PUBLICATIONS http://www.marinespecialties.com/boatpix/products/image/folding_tower_2.jpg, downloaded from Internet Jun. 21, 2023, 1 page.

* cited by examiner

COMPACTIBLE HELM STATION FOR A MARINE VESSEL

FIELD OF THE INVENTION

The invention relates to a compactible helm station for a marine vessel.

BACKGROUND OF THE INVENTION

Helm stations are known to be disposed in various locations about a marine vessel. Some helm stations are open, some are disposed in a cabin, some are disposed atop a lower area, and some are even disposed toward a rear of the vessel to aid in backing into a slip and the like. Sometimes there are more than one helm station. Certain vessels often have a helm station disposed atop a lower area that itself has a helm station. Such an elevated helm station, often referred to as a second station when there is another station below, provides an elevated vantage point that can be useful when operating the vessel and when participating in certain activities, such as fishing.

While elevated helm stations provide advantages, they also have distinct disadvantages. For example, an elevated helm station can make the vessel harder to maneuver in rough seas due at least to the extra weight associated with the elevated helm station which is also disposed relatively high over the vessel. The weight and elevated location of the elevated station can also exert significant forces on the vessel when the boat pitches and rolls in rough sea conditions. Ensuring structural integrity of the elevated helm station can cause the operator to greatly reduce the speed at which the vessel can be operated in rough conditions. This, in turn, can increase the amount of time the vessel is exposed to the rough seas, making it harder to outrun or get out of a storm, which is a safety concern. In addition, the elevated station can negatively affect fuel mileage due to the reduced overall aerodynamics of the vessel. Further, will allow the vessel to pass under lower-clearance bridges. For those vessels stored in rack storage units, the increased height of the vessel due to the elevated helm station takes up more space in the rack storage unit. Rack storage unit with storage space sufficient to accommodate an elevated helm station can be hard to find. When found, the cost can be significantly more than compared to that of a vessel without the elevated helm station because the elevated helm station occupies space that could be used to store another vessel. Hence, there is room in the art for improvement.

BRIEF DESCRIPTION OF THE DRAWINGS

The invention is explained in the following description in view of the drawings that show.

DETAILED DESCRIPTION OF THE INVENTION

The present inventor has developed a unique and innovative apparatus that creates an occupant station when in a raised configuration, but which can be compacted into a stowed configuration. In example embodiments, the occupant station is a helm station that allows an operator to use vessel controls to operate the vessel when in the raised configuration, but which also compacts into the stowed configuration. The occupant station may optionally be disposed over a lower area of the vessel. Example lower areas include a cabin and a lower helm station.

Figure 1:
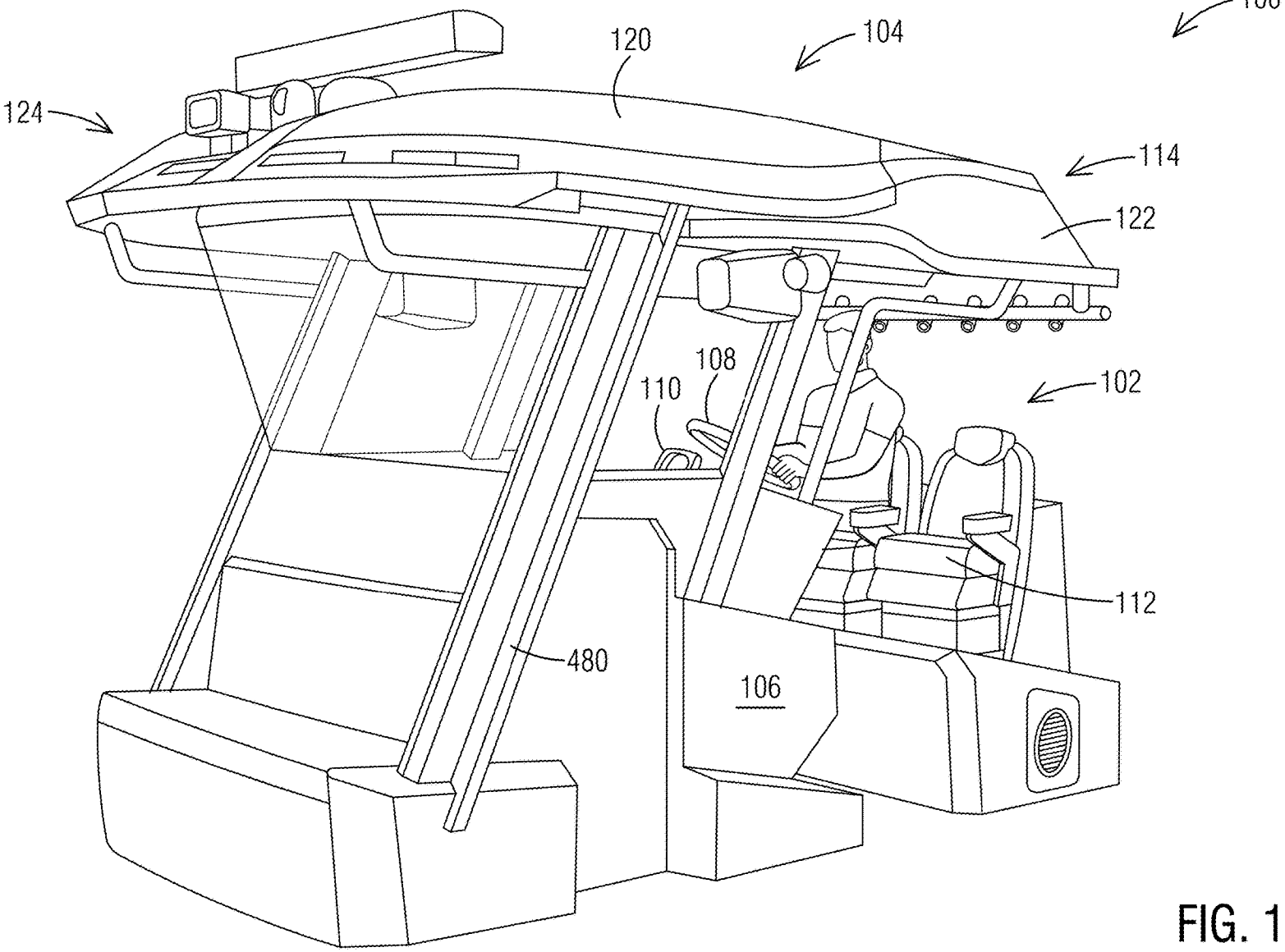
FIG. 1 shows an example embodiment of a lower helm station with an example embodiment of a compactible helm station assembly in a stowed configuration.
Figure 2:
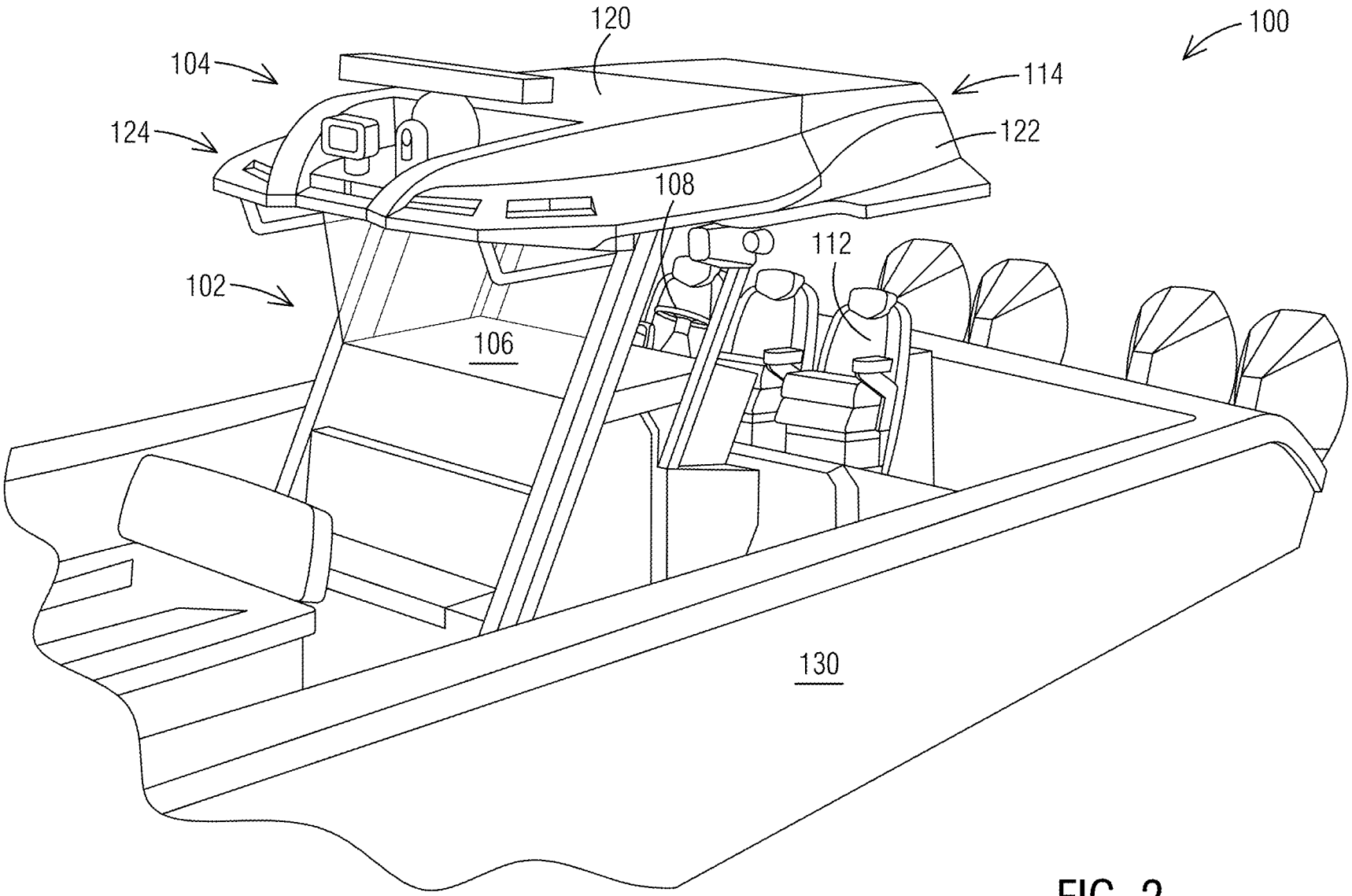
FIG. 2 shows an example embodiment of a vessel with the lower helm station of FIG. 1 and the compactible helm station assembly in the stowed configuration
Figure 3:
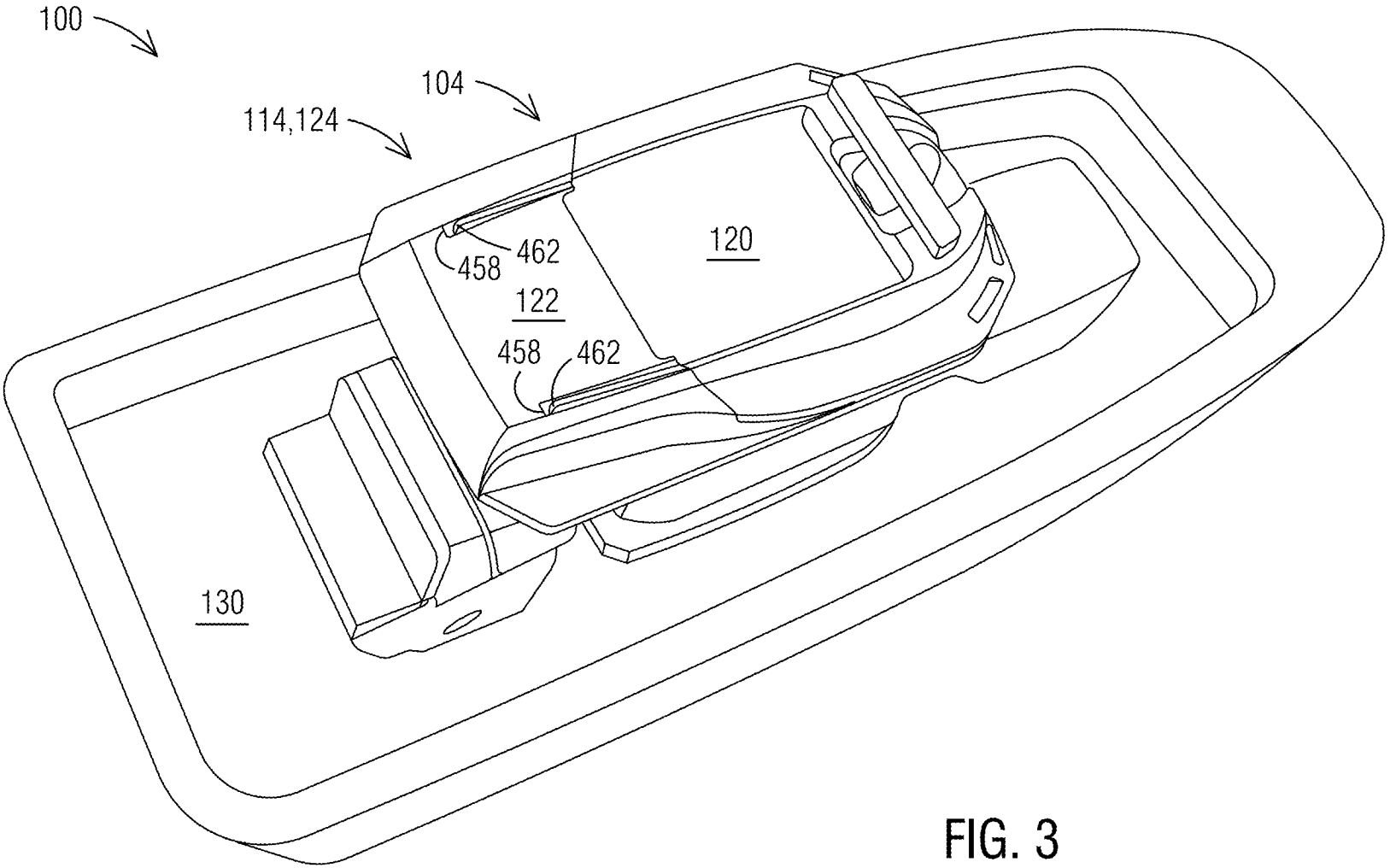
FIG. 3 shows a top view of the compactible helm station assembly of FIG. 1 in the stowed configuration.
Figure 4:
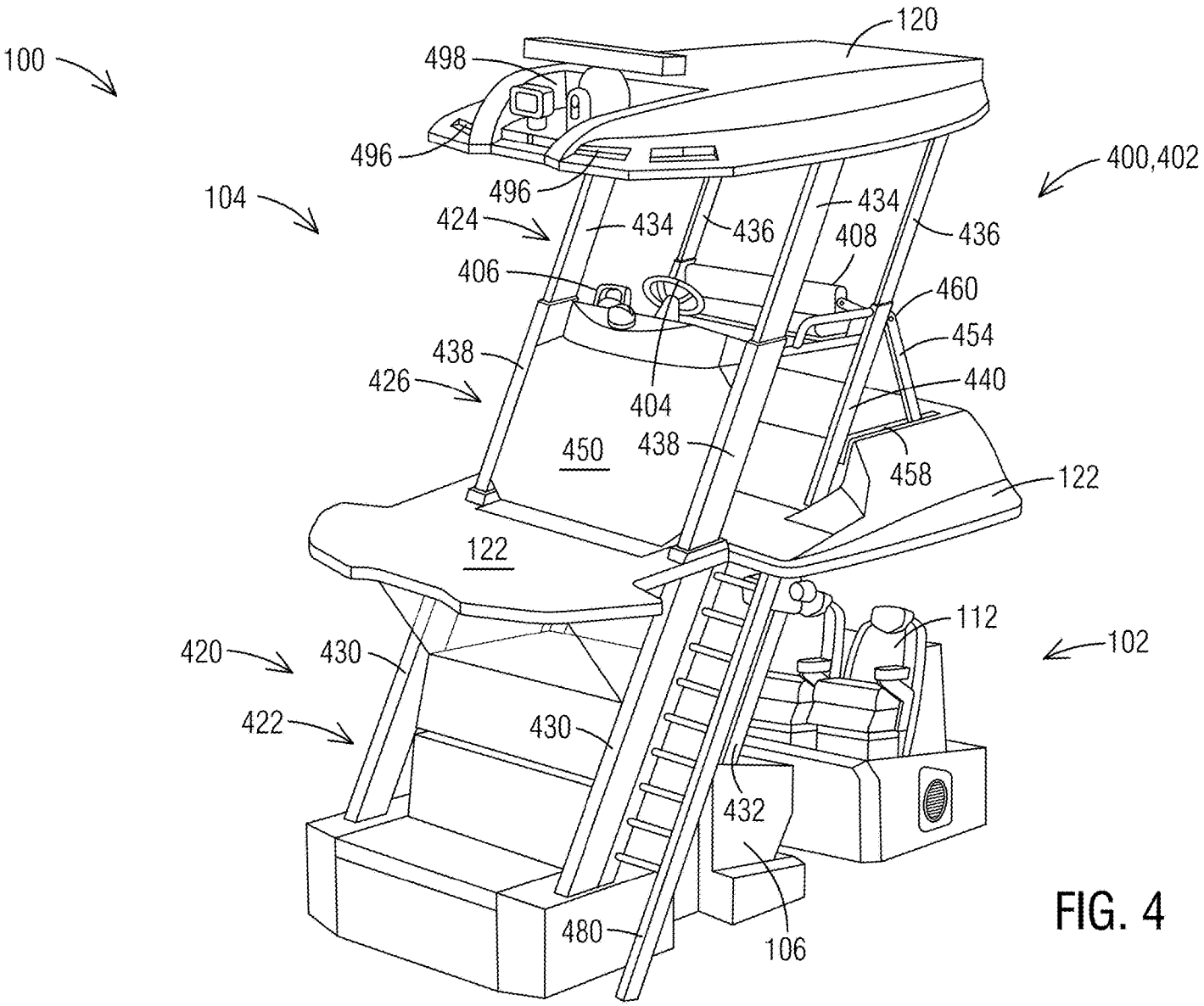
FIG. 4 shows the lower helm station of FIG. 1 with the compactible helm station assembly in a raised configuration.
Figure 5:
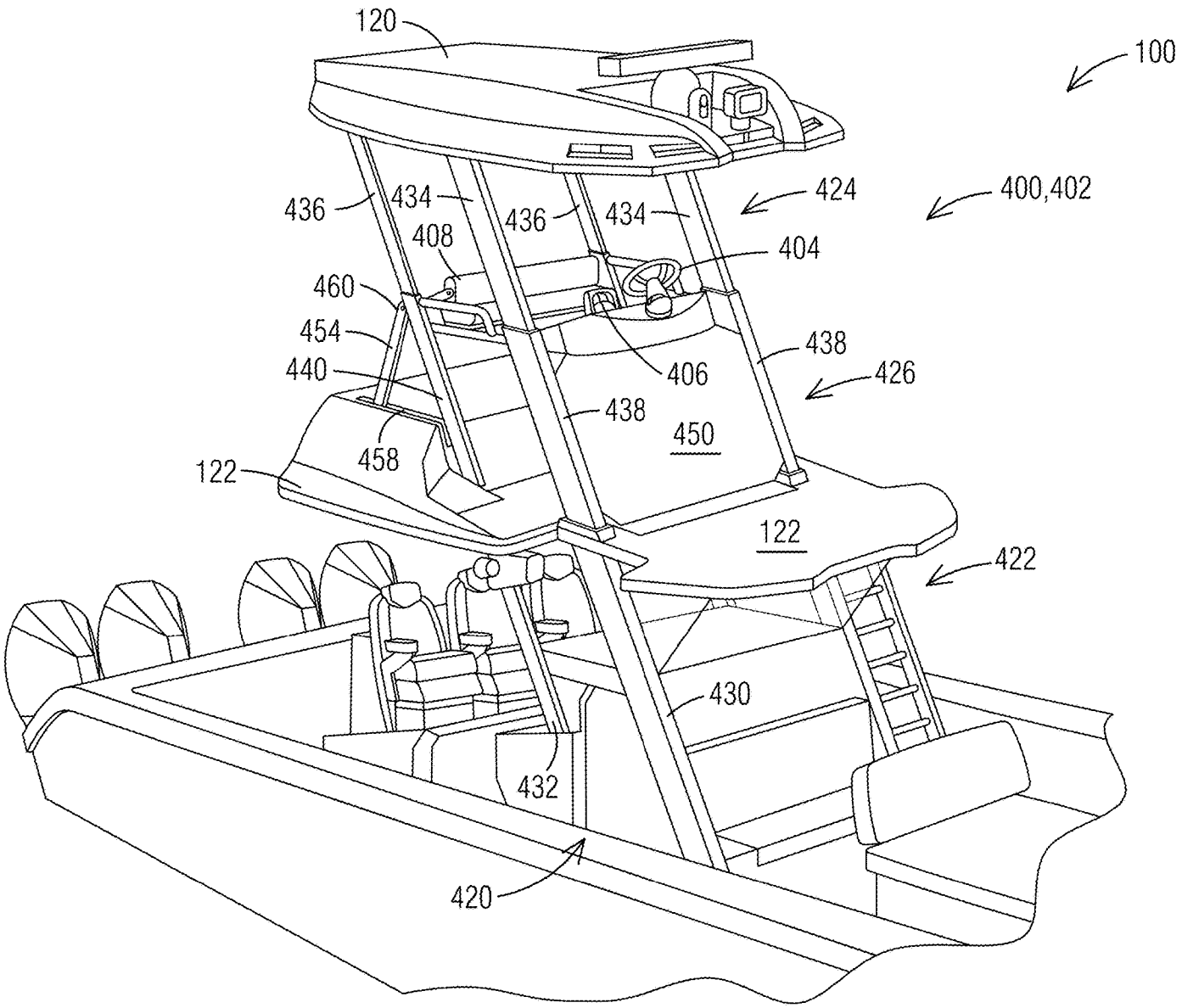
FIG. 5 shows the vessel of FIG. 2 with the compactible helm station assembly in the raised configuration.
Figure 6:
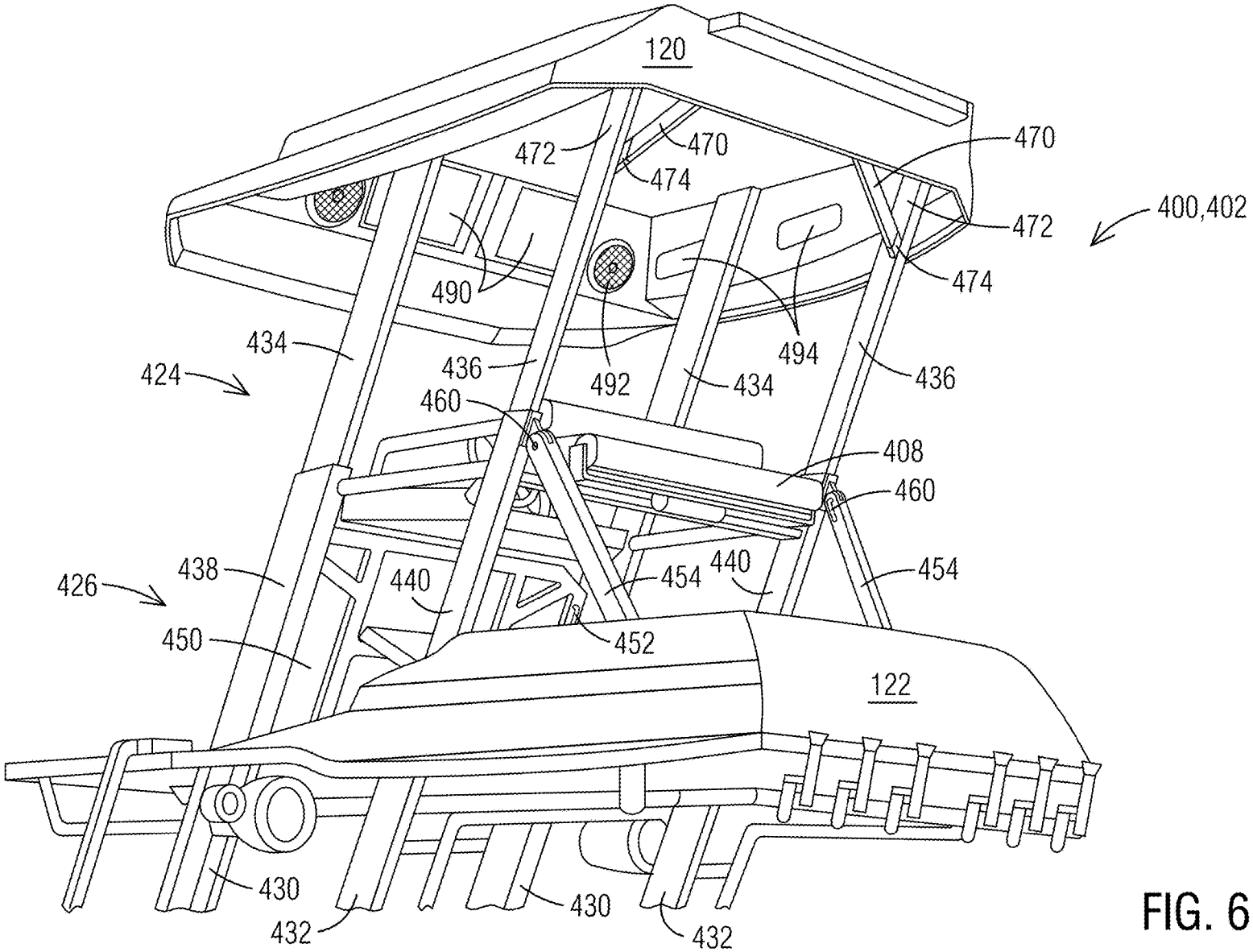
FIG. 6 shows the compactible helm station assembly of FIG. 1 in the raised configuration.
Figure 7:
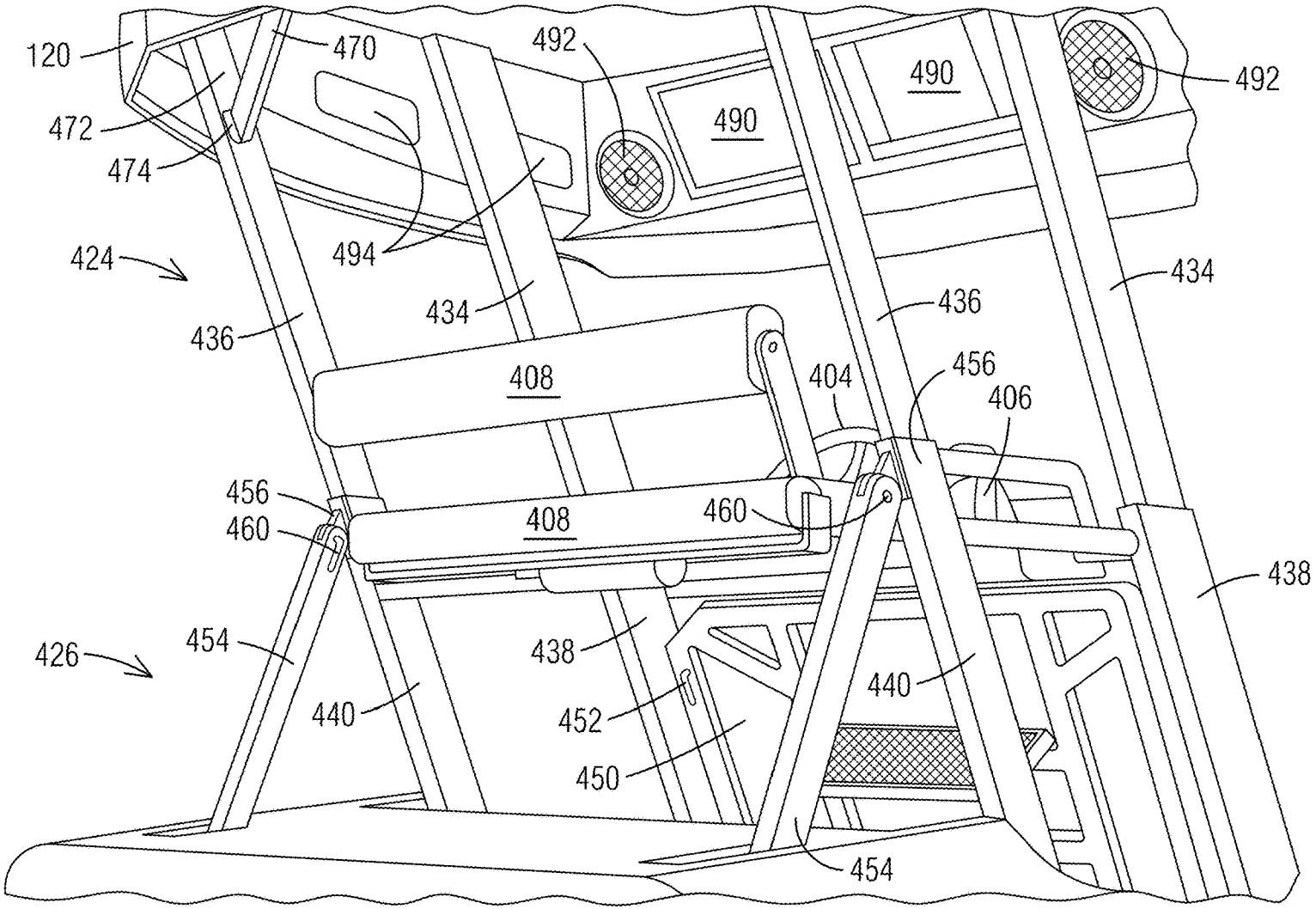
FIG. 7 is a closeup of the collapsible helm station assembly of FIG. 1 in the raised configuration.

FIG. 1 to FIG. 3 show an example embodiment of an apparatus 100 with a lower helm station 102 with an example embodiment of a compactible helm station assembly 104 in a stowed configuration. The lower helm station 102 includes a lower helm station console 106, lower helm station vessel controls such as a lower helm station steering wheel 108 and a lower helm station throttle 110, a lower helm station seat 112, and a lower helm station top 114. The lower helm station top 114 includes an upper structure 120 and a lower structure 122. As shown in FIG. 1 to FIG. 3, when the compactible helm station assembly 104 is in a stowed configuration, the upper structure 120 and the lower structure 122 combine to form an integrated top 124 for the lower helm station 102. As can be seen in FIG. 2, the integrated top 124 is a T-top for a center console 130 type of vessel. However, the integrated top 124 can be a top for any type of vessel. The integrated top can be installed over an occupant station with vessel controls (e.g., an open or an enclosed helm station) or without vessel controls (e.g., a cabin without helm controls). Alternately, the lower structure 122 can be any surface of a vessel, such as a deck/floor of any level.

FIG. 4 to FIG. 7 show the compactible helm station assembly 104 in a raised configuration in which the upper structure 120 is a top (e.g., a T-top) of an occupant station 400 that is formed only when the compactible helm station assembly 104 is in the raised configuration. As used herein, an occupant station includes at least a volume suitable for an occupant and includes a floor and a top. In this example embodiment, the occupant station 400 is a particular type of occupant station, namely a helm station. A helm station is an occupant station having vessel controls. In particular, this is an elevated helm station 402 with an elevated helm station steering wheel 404 and/or an elevated helm station throttle 406. Since there is a different/lower helm station 102 in this example embodiment, this elevated helm station 402 is also a second helm station. In this configuration, the lower structure 120 acts as a top (e.g., a T-top) for the lower helm station 102 while also acting as a floor for the occupant station 400. The occupant station 400/elevated helm station 402 further includes an optional elevated helm station seat 408 that can be used as a seat and/or a bolster. In an example embodiment, the upper structure 120 can be raised by as much as seven (7) feet.

The apparatus 100 includes an example embodiment of an actuator assembly 420 that includes an actuator base 422, a first member 424, and a second member 426. The actuator base 422 supports the lower structure 122 over the lower helm station 102. The first member 424 and the second member 426 extend from the actuator base 422 to raise the upper structure 120, the helm station controls, and the elevated helm station seat 408. In an example embodiment, first member 424 extends from the actuator base 422 and raises the upper structure 120 which is secured to the first member 424. The second member 426 extends from the actuator base 422 and raises the helm controls and the elevated helm station seat 408. In an example embodiment, first member 424 extends further from the actuator base 422 than does the second member 426. In an example embodiment, the second member 426 telescopes from the actuator base 422 and the first member 424 telescopes from the second member 426. However, any suitable lifting technology that can raise and lower a member can us used, such as hydraulics or lead screws. Alternately, the first member 424 and the second member 426 can be manually lifted into place. In such manual example embodiments, the lifting may be assisted by the use of springs and/or counterweights etc.

In the example embodiment shown, the first member 424 and the second member 426 can be raised independently of each other. As such, first member 424 can raise the upper structure 120 to a first height suitable for a standing occupant, or to a second, relatively lower height suitable for a sitting occupant. The independent adjustment of the first member 424 enables a distance between the standing occupant and the upper structure 120 to be the same for the standing and the sitting occupant. This reduces the negative effects associated with height to some degree and also ensures the greatest shade protection for the occupant in the various configurations.

In the example embodiment shown, actuator base 422 includes four parallel base members including two front base members 430 and two rear base members 432. The first member 424 includes four parallel first members including two front first members 434 and two rear first members 436. Likewise, the second member 426 includes four parallel second members including two front second members 438 and two rear second members 440.

In an example embodiment, two front second members 438 are at least partially hollow such that the two front second members 438 each define a respective channel. The two front first members 430 may each be at least partially disposed in a respective channel. Such a telescoping assembly is disclosed in U.S. Pat. No. 11,046,397 to Oswell, entitled "Telescoping Tower for a Boat", filed on Aug. 14, 2019, which is incorporated in its entirety herein.

In the example embodiment shown, compactible helm station assembly 104 further includes a structure panel 450 configured to be deployed into a structure panel stiffening position (shown in FIGS. 4-7) configured to stiffen the two front second members 438 of the second member 426 when the compactible helm station assembly 104 is in the raised configuration. The structure panel 450 is pivotally connected to the two front second members 438 via respective pivot connections 452 which allow the structure panel 450 to move between the structure panel stiffening position and a structure panel folded position suitable to enable the compactible helm station assembly 104 to be compacted into the stowed configuration. In an example embodiment, the pivot connections 452 include cam lock levers (e.g., 2000-pound cam lock levers) that lock the panel into either or both the structure panel stiffening position and the structure panel folded position. In various embodiments, the pivot connection can be disposed at the bottom of the structure panel 450 and latches at the top, or the reverse. Alternately, the structure panel 450 can be disconnected and placed and/or secured in a storage position suitable for storage when the compactible helm station assembly 104 is in the stowed configuration or storage elsewhere.

In the example embodiment shown, the compactible helm station assembly 104 further includes support brackets 454 configured to move between a support bracket stiffening position (shown in FIGS. 4-7) by bracing an end 456 of the second member 426 against the lower structure 122 when the compactible helm station assembly 104 is in the raised configuration, and a support bracket folded position (see e.g., FIG. 3) when the compactible helm station assembly 104 is compacted into the stowed configuration. In the example embodiment shown, the support brackets 454 rest in support bracket pockets 458 (see e.g., FIG. 3) of the lower structure 122 when the compactible helm station assembly 104 is compacted into the stowed configuration. In the example embodiment shown, each support bracket 454 is pivotally connected to a respective rear second member 440 via respective pivot connections 460. In an example embodiment, the pivot connections 460 include cam lock levers that lock the support brackets 454 into either or both the support bracket stiffening position and the support bracket folded position. A distal end 462 of the support brackets 454 rests in or is secured in the respective support bracket pocket 458 via conventional means such as fasteners, connectors, and the like.

In the example embodiment shown, the compactible helm station assembly 104 further includes upper support brackets 470 configured to move between an upper support bracket stiffening position (shown in FIGS. 4-7) by bracing an end 472 of the first member 424 against the upper structure 120 when the compactible helm station assembly 104 is in the raised configuration, and an upper support bracket folded position when the compactible helm station assembly 104 is compacted into the stowed configuration. In the example embodiment shown, each upper support bracket 470 is pivotally connected to a respective rear first member 436 via respective pivot connections 474. In an example embodiment, the pivot connections 474 include cam lock levers that lock the upper support brackets 470 into either or both the upper support bracket stiffening position and the upper support bracket folded position. A distal end 476 of the support brackets 454 is secured to the upper structure 120 via respective upper support bracket connections 478 (see e.g., FIG. 12). The support brackets 454, the upper support brackets, and the structure panel 450 can individually be referred to generally as stiffening components.

In the example embodiment shown, a stowable ladder 480 provides access to the elevated helm station 402 when the compactible helm station assembly 104 is in the raised configuration. In an example embodiment, the stowable ladder 480 is secured to and stows into one of the front base members 430. The stowable ladder 480 is shown in a deployed configuration in FIG. 4, and in a stowed configuration in FIG. 1. The stowable ladder 480 may be stowed by pushing the ladder into the respective front support. Alternately, the stowable ladder 480 may have rungs that pivot at both ends such that the rungs can pivot and thereby collapse the port rail toward the starboard rail or vice versa.

In the example embodiment shown, the upper structure 120 includes one or more electronic displays 490 and/or speakers 492 mounted therein, and other equipment can likewise be accommodated in the upper structure 120. In the example embodiment shown, the upper structure 120 also includes one or more overhead storage areas 494. In the example embodiment shown, the upper structure 120 also includes light recesses 496 configured to receive a respective light (e.g., a navigational light) and an electronics recess 498 configured to receive a radar unit and the like.

Components of the apparatus 100 could be made of fiberglass, carbon fiber, or aluminum or any other suitable material.

Figure 8B:
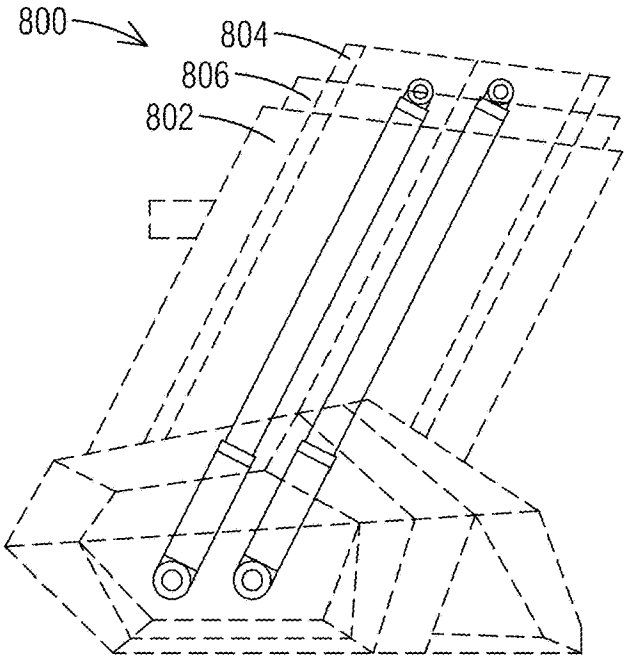
FIG. 8B illustrates the front members of FIG. 8A in a retracted configuration.
Figure 8A:
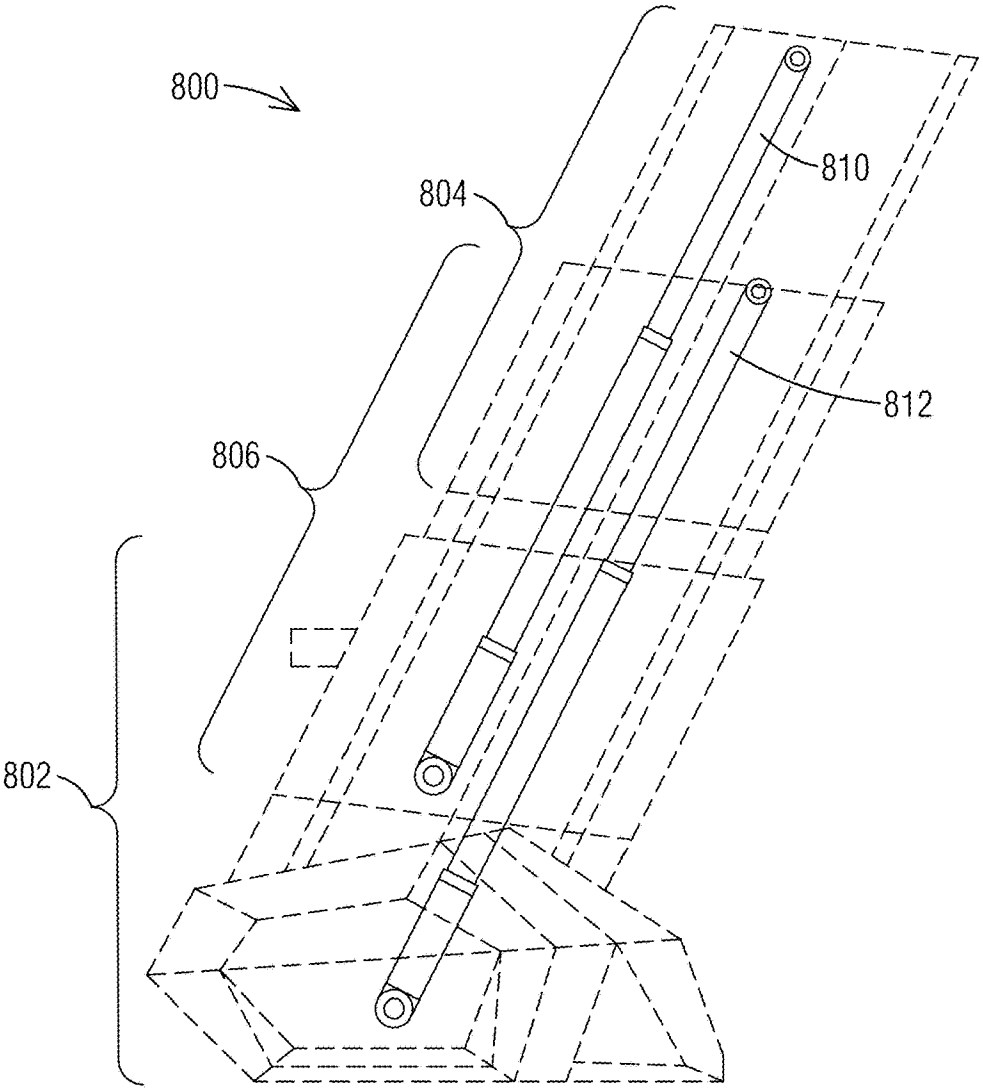
FIG. 8A illustrates an example embodiment of at least a front member of an example embodiment of an actuator assembly in an extended configuration.

FIG. 8A illustrates an example embodiment of at least a front member 800 of an example embodiment of an actuator assembly in an extended configuration. FIG. 8B illustrates the front member 800 in a retracted configuration. The front member 800 includes a front base member 802, front first member 804 and a front second member 806. The front member 800 of the actuation assembly further includes a first actuator 810 secured to the front first member 804 and to the front second member 806. The front member 800 further includes a second actuator 812 secured to the front second member 806 and to the front base member 802. Extension and retraction of the first actuator 810 extends and retracts the front first member 804 relative to the front second member 806. Extension and retraction of the second actuator 812 extends and retracts the front second member 806 relative to the front base member 802.

In this arrangement, the front first member 804 floats with the front second member 806. This permits the front first member 804 to extend further from the front base member 802 than the front second member 806 by taking advantage of the extension of the front second member 806. This example embodiment is not meant to be limiting and the artisan will understand other variations may be suitable to achieve the desired extension. Further, there may be actuators in any number of the members, including just one member, all the members, or any number in between. Any or all the two front members and the two rear members may be constructed as is shown in FIG. 8A and FIG. 8B. Alternately, any or all of the two front members and the two rear members may be constructed using configurations known to the artisan.

Figure 9:
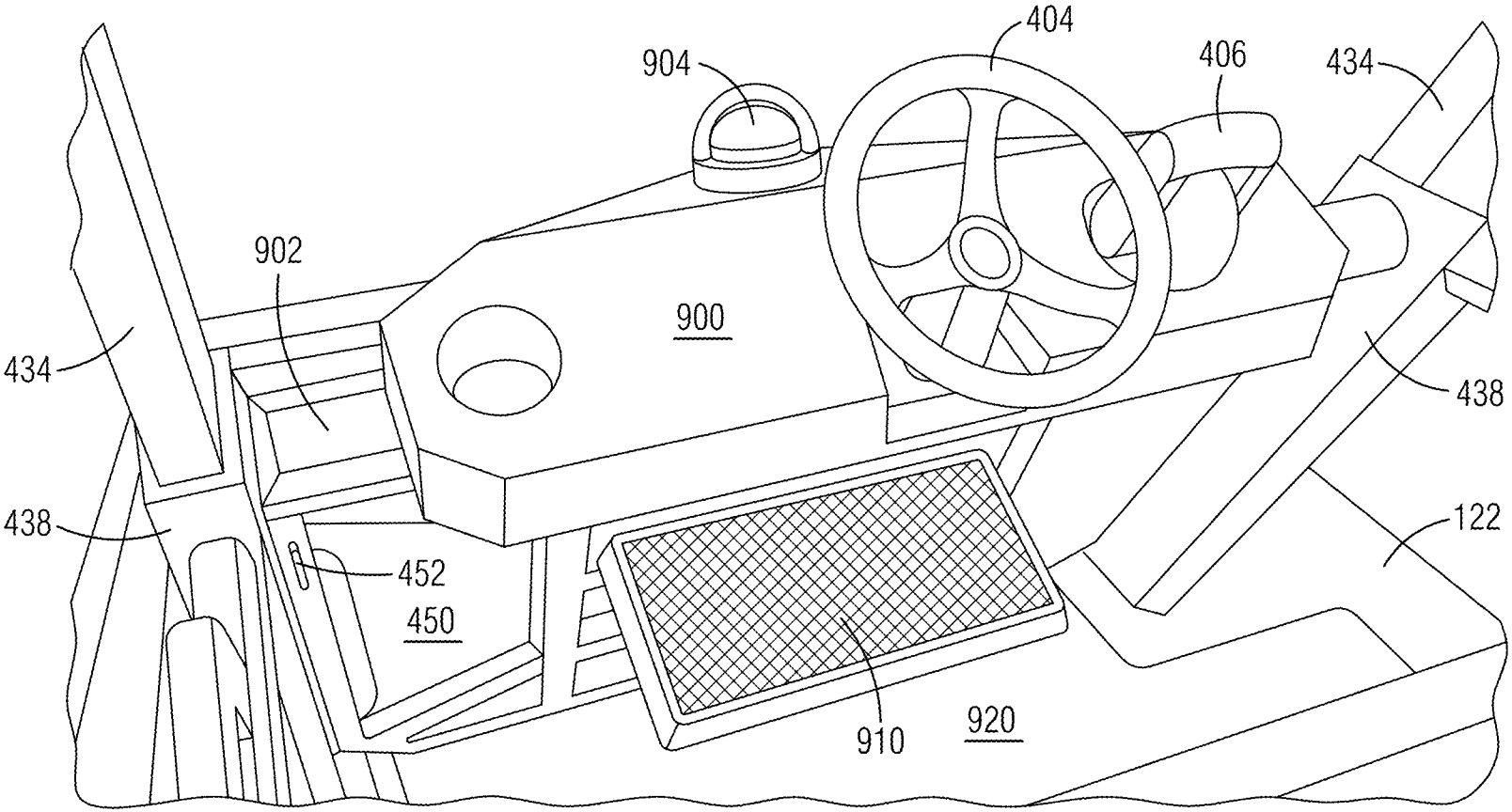
FIG. 9 shows the compactible helm station assembly of FIG. 1 in the raised configuration and an example embodiment of helm controls.

FIG. 9 shows the compactible helm station assembly 104 in the raised configuration and an example embodiment of helm controls. The elevated helm station steering wheel 404 is disposed on a station control panel 900 that is disposed on a helm cross bar 902 that spans the two front second members 438. The elevated helm station throttle 406 is similarly disposed on the station control panel 900. Other accessories like a compass 904 and the like can likewise be disposed on the station control panel 900. The helm cross bar 902 may be rigidly secured to the two front second members 438 (e.g., welded, bolted), or it may be pivotally adjustably secured and/or height adjustably secured thereto.

Also visible is a footrest 910 disposed on the structure panel 450 and configured to move between a footrest raised position (shown) when the structure panel 450 is in the structure panel stiffening position (shown) and a footrest folded position suitable to enable the structure panel 450 to be moved into the structure panel folded position. Optionally, a nonskid flooring 920 may be disposed on the lower structure 122, which is acting as a floor for the elevated helm station 402.

Figure 10:
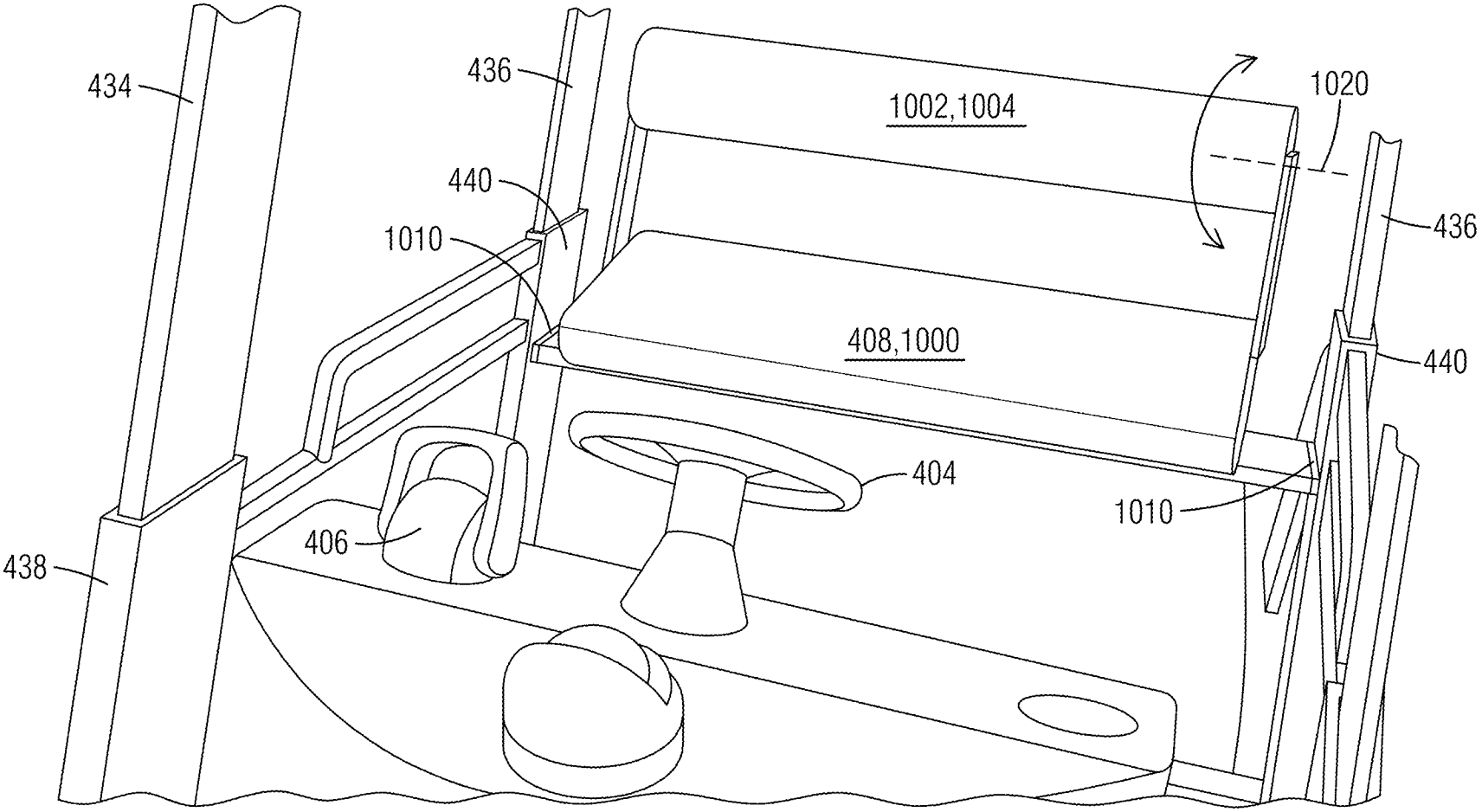
FIG. 10 shows the compactible helm station assembly of FIG. 1 in the raised configuration and an example embodiment of a seat with an example embodiment of a backrest in an unfolded position.
Figure 11:
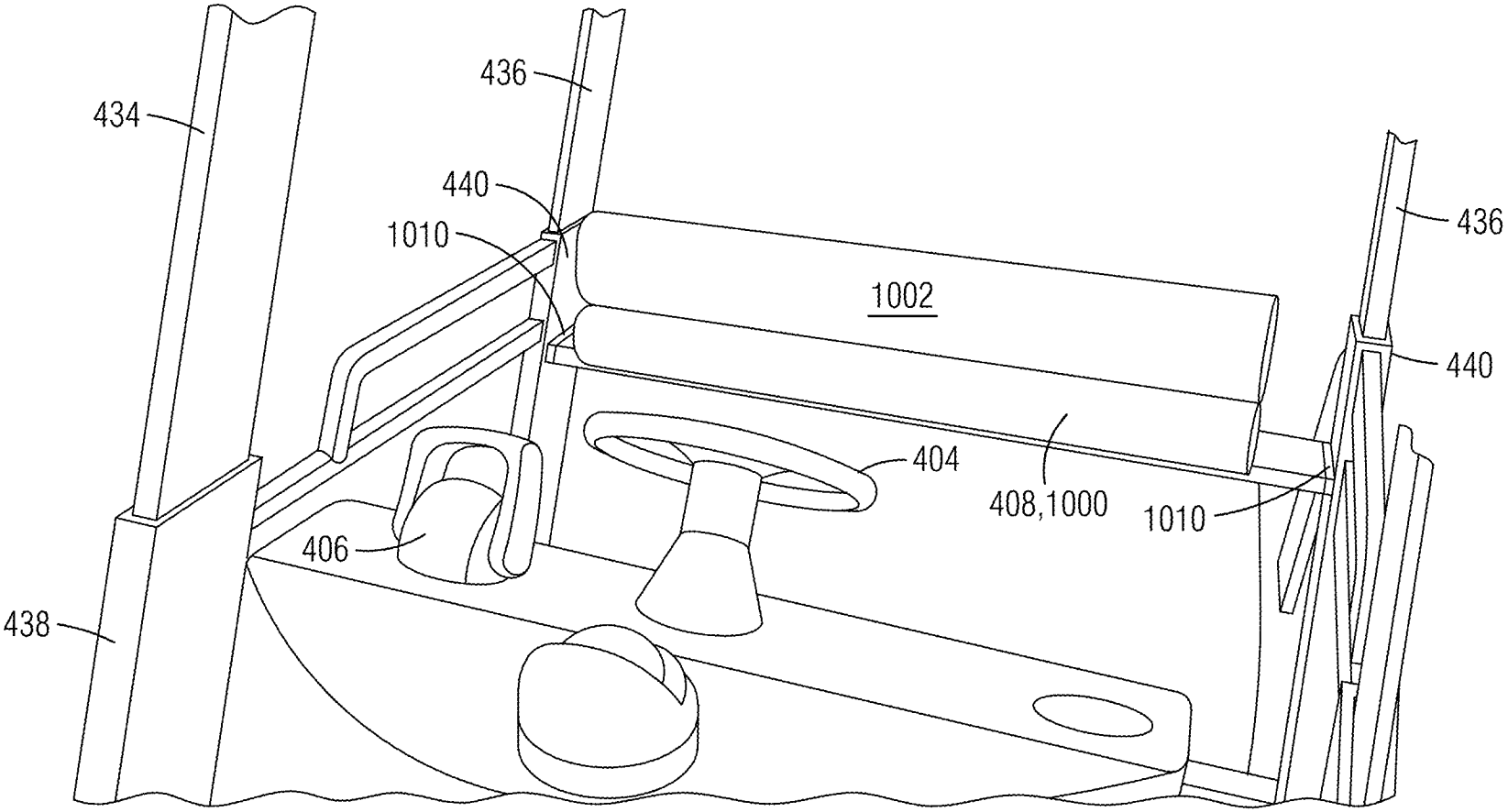
FIG. 11 and FIG. 12 show the seat of FIG. 10 with the backrest in the folded position.
Figure 12:
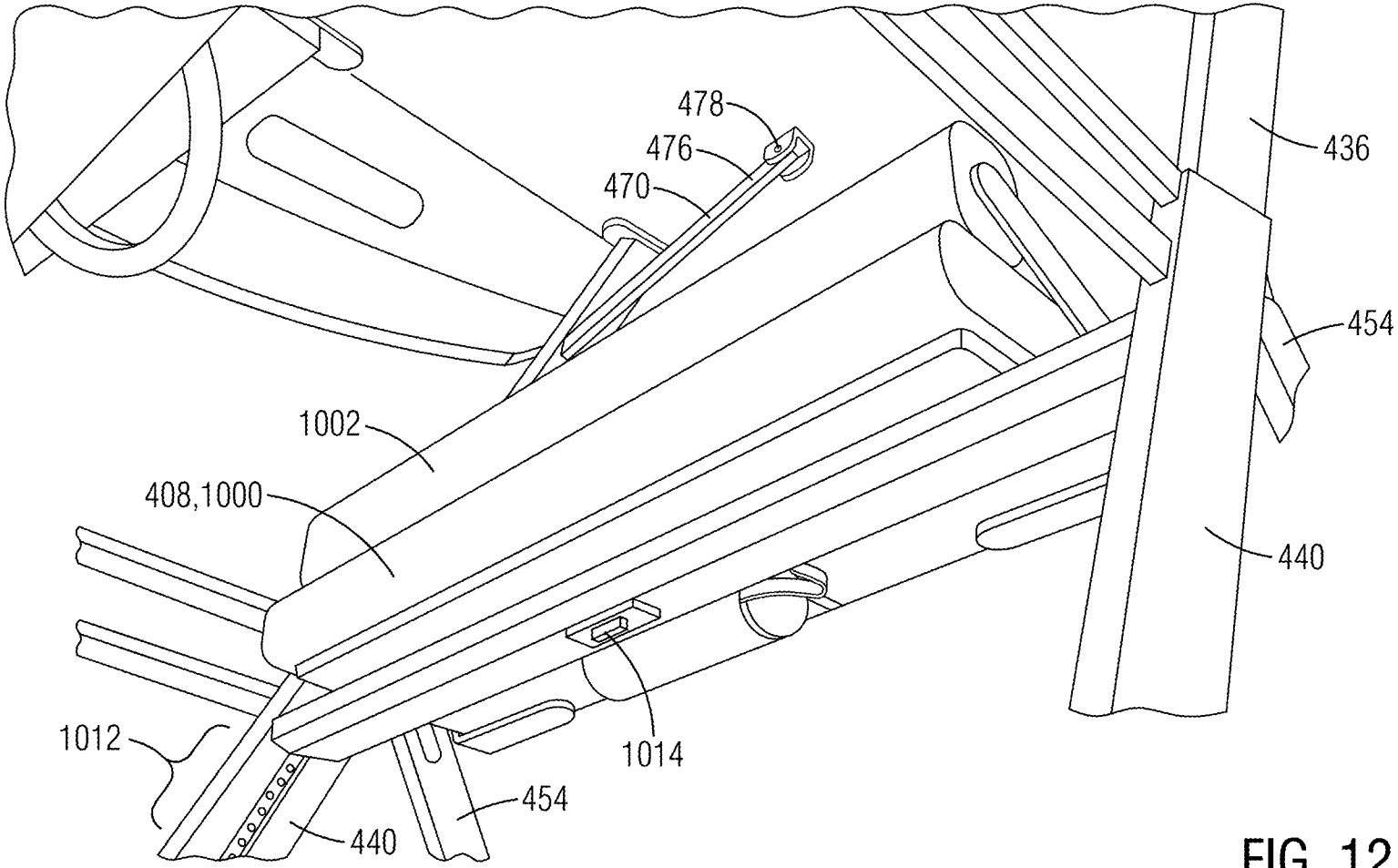

FIG. 10 to FIG. 12 show the compactible helm station assembly 104 in the raised configuration and an example embodiment of an elevated helm station seat 408. The elevated helm station seat 408 includes a seat bottom 1000 and a backrest 1002 that includes a bolster 1004. The elevated helm station seat 408 is secured to the two rear second members 440 of the second member 426 via vertically adjustable seat connections 1010 configured to allow for vertical adjustment of the elevated helm station seat 408 along the two rear second members 440. In this example embodiment, the vertically adjustable seat connections 1010 include a plurality of vertically arranged holes 1012 in the two rear second members 440 of the second member 426 and a pin engagement actuated by a paddle 1014. The backrest 1002 is configured to move between a backrest unfolded position (FIG. 10) to function as the backrest 1002 when the compactible helm station assembly 104 is in the raised configuration, and a backrest folded position (FIG. 11) suitable to enable the compactible helm station assembly 104 to be compacted into the stowed configuration. The backrest 1002 can also be locked into several positions between the backrest unfolded position and the backrest folded position. In addition, the bolster can rotate ninety (90) degrees about bolster axis 1020. The elevated helm station seat 408 may also be adjustable fore and aft using configurations known to the artisan.

Figure 13:
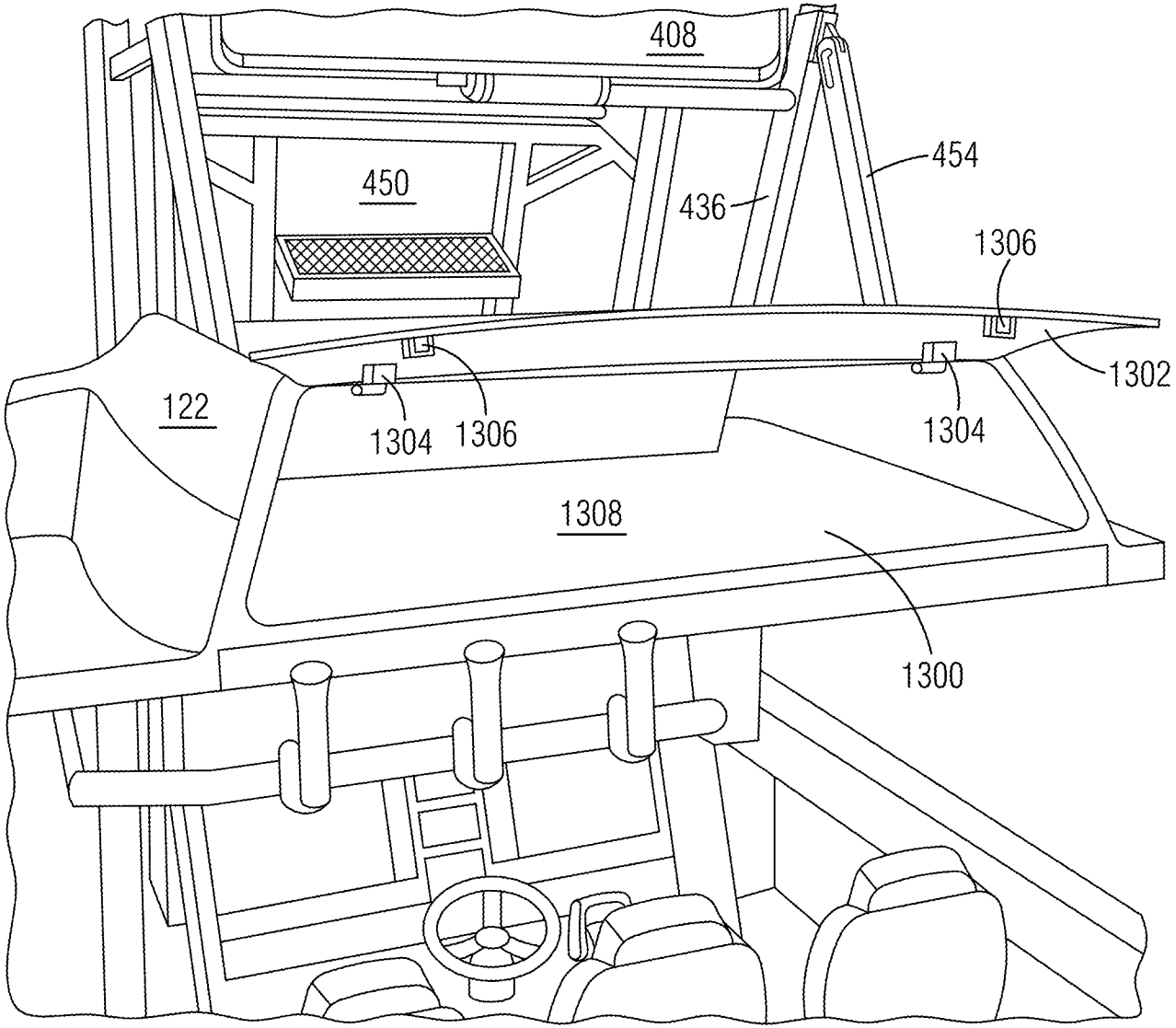
FIG. 13 shows an example embodiment of a storage area over the lower helm station of FIG. 1.

FIG. 13 shows an example embodiment of a rear storage area 1300 in the lower structure 122 that is disposed over the lower helm station 112. The rear storage area 1300 may have a rear storage area door 1302 secured to the lower structure 122 via spring hinges 1304 as well as latches 1306. The rear storage area 1300 may also have an optional liner 1308 to keep items in the rear storage area 1300 from moving around.

Figure 14B:
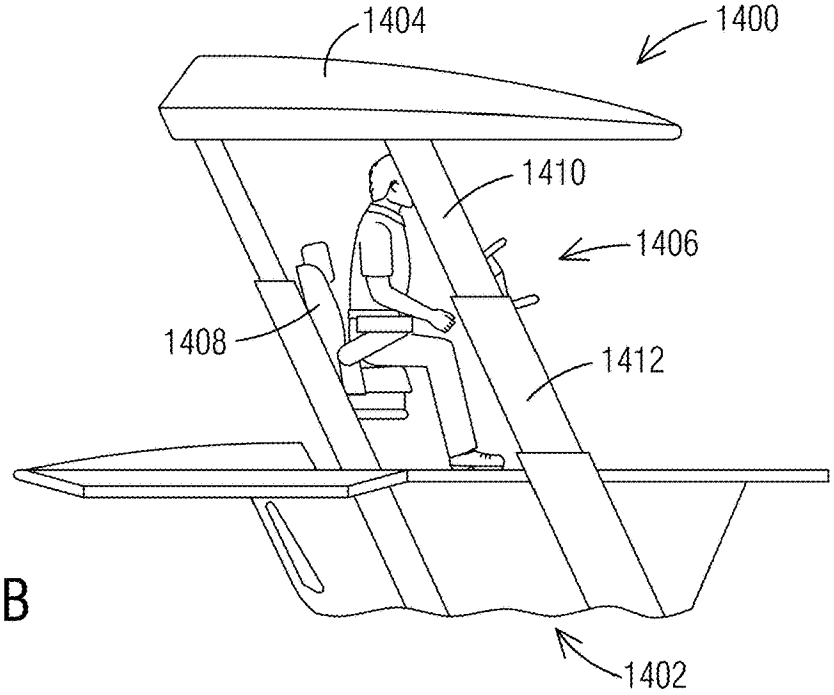
FIG. 14B shows the compactible helm station assembly of FIG. 14A in a second extended configuration.
Figure 14A:
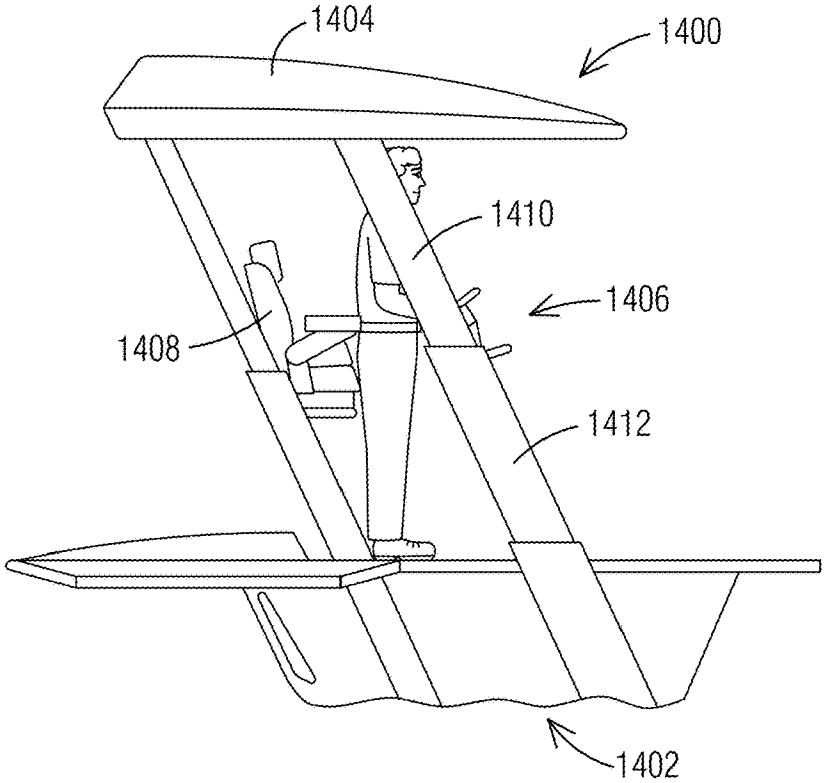
FIG. 14A shows an alternate example embodiment of a compactible helm station assembly in a first extended configuration.

FIG. 14A shows an alternate example embodiment of a compactible helm station 14A00 in a first extended configuration. FIG. 14B shows the compactible helm station 1400 a second extended configuration. The actuator assembly 1402 may be similar to the actuator assembly 420 of the embodiment of FIG. 1 to FIG. 7. In the first extended configuration, the upper structure 1404 is extended further than in the second extended configuration. Similarly, in the first extended configuration the helm controls 1406 are extended further than in the second extended configuration. If the seat 1408 is connected as detailed above, the seat 1408 will adjust with the helm controls 1406. In addition, the seat 1408 may further be manually adjusted in height using vertically adjustable seat connections such as those detailed above. In an example embodiment, not meant to be limiting, a vertical height difference of the upper structure 1404 between the first extended configuration and the second extended configuration is eighteen (18) inches, thought it can be greater or less.

In any of the example embodiments, the first member 1410 and the second member 1412 may be independently adjustable to achieve a desired position for the upper structure 1404 and a desired position for the helm controls 1406. Hence, the compactible helm station 1400 may be configured to provide an infinite range of positions for the upper structure 1404, for the helm controls 1406, and for the seat 1408 from the stowed configuration to the raised configuration inclusive.

The first extended configuration may be suitable for an operator that is standing whereas the second extended configuration may be suitable for an operator that is sitting. In the second extended configuration lowering the upper structure 1404 reduces the negative effects associated with height of the upper structure 1404 to some degree and also ensures the greatest shade protection for the sitting occupant.

Figure 15B:
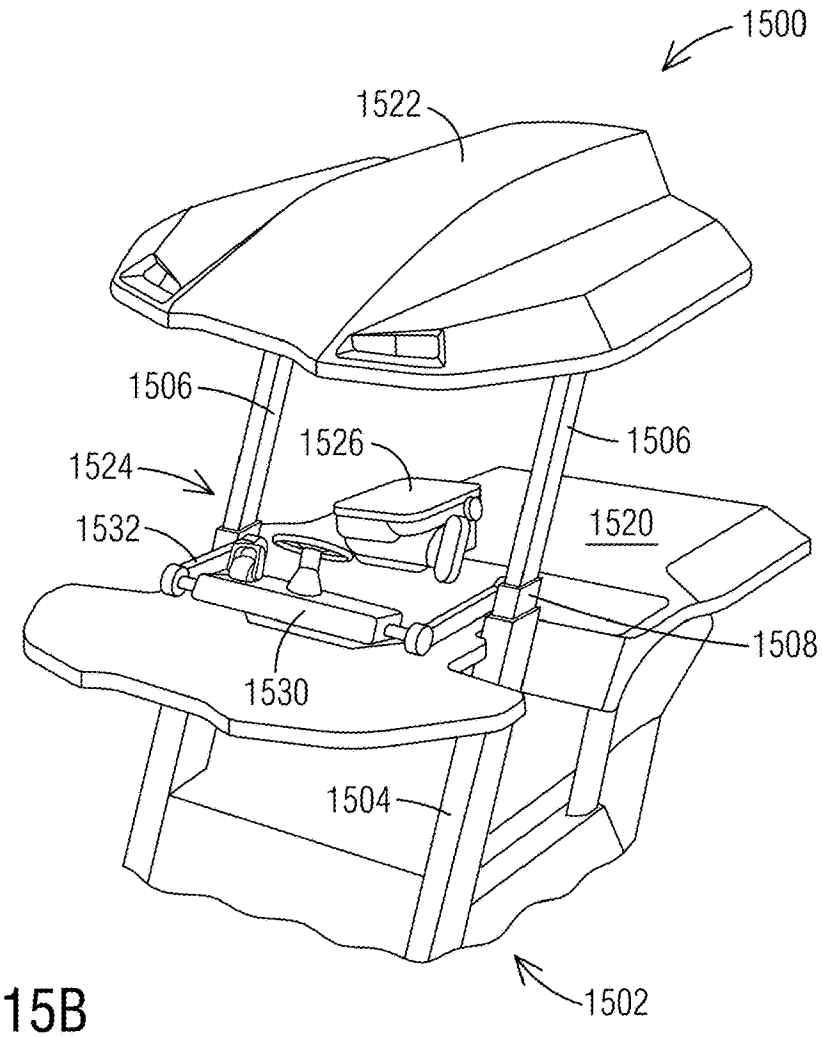
FIG. 15A to FIG. 15D show an alternate example embodiment of a compactible helm station assembly starting in a stowed configuration and leading to a raised configuration.
Figure 15A:
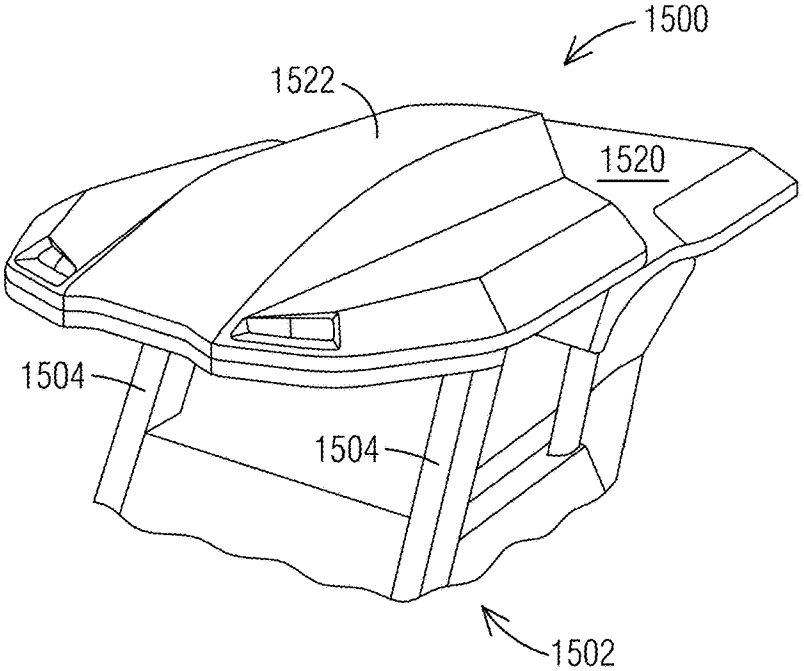
Figure 15D:
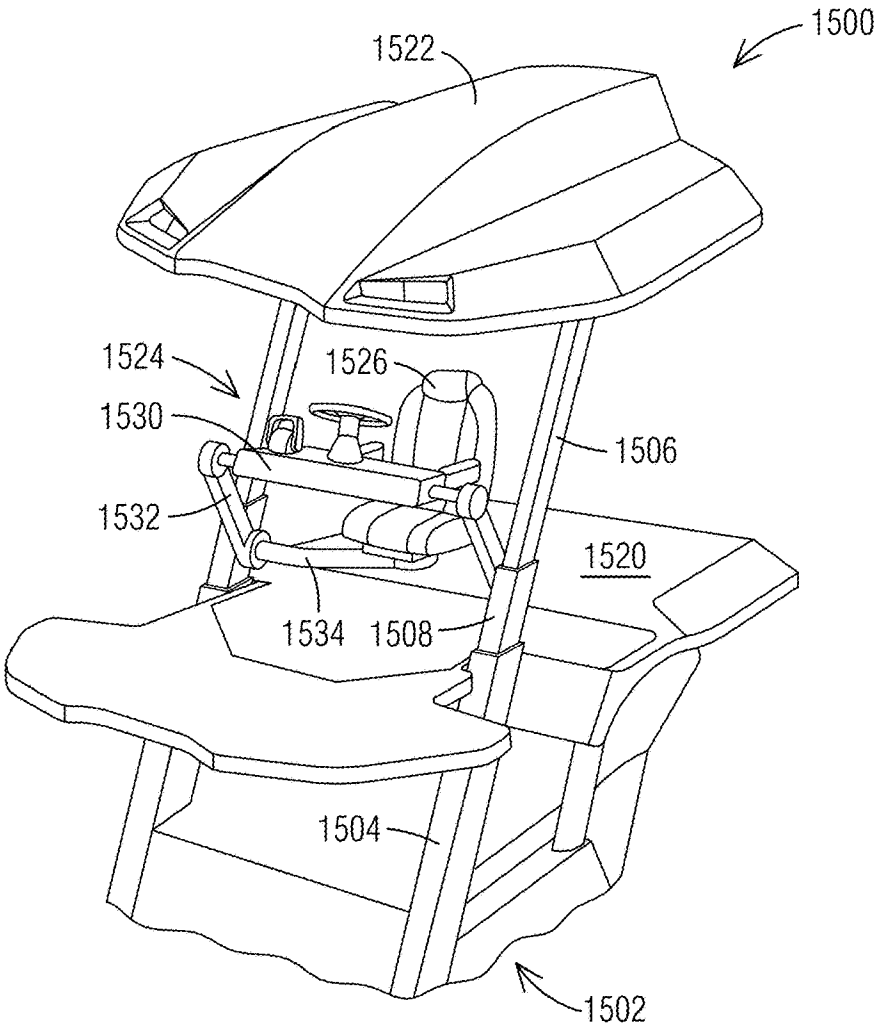
Figure 15C:
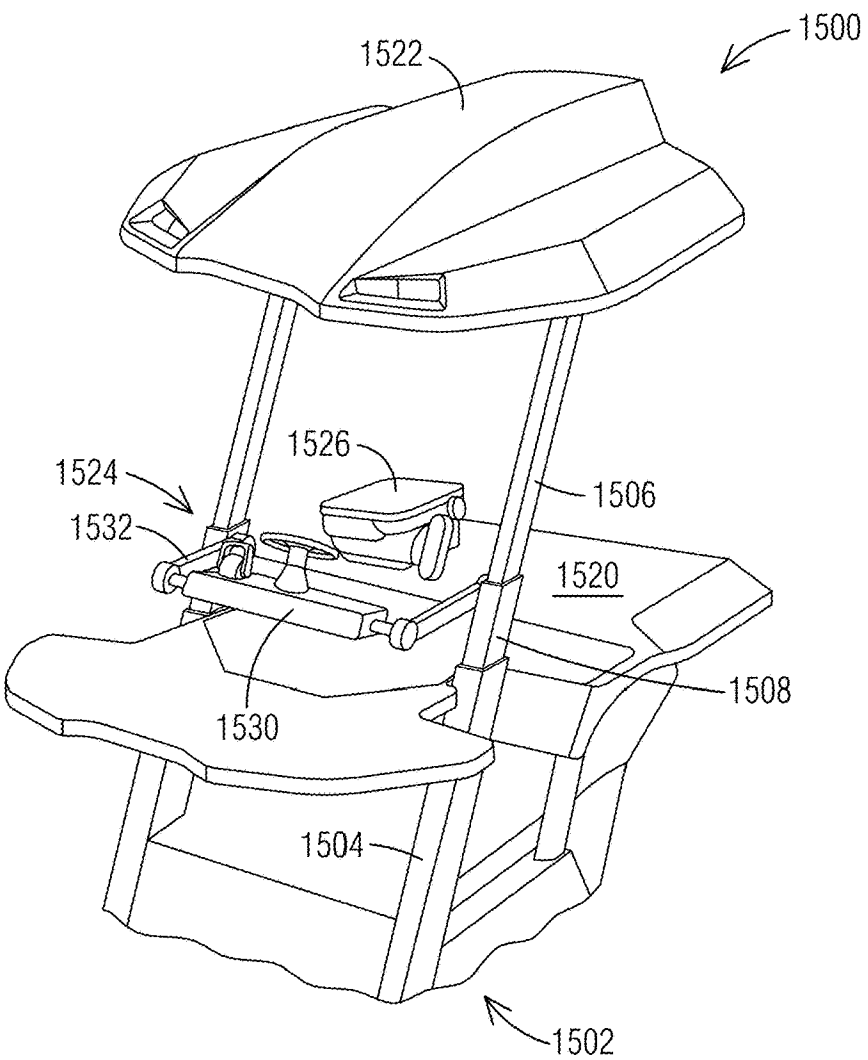

FIG. 15A to FIG. 15D show an alternate example embodiment of a compactible helm station 1500 starting in a stowed configuration of FIG. 15A and leading to a raised configuration of FIG. 15D. The actuator assembly 1502 of this example embodiment is similar to the actuator assembly 420 above in that it includes front members, but it is different in that it does not include rear members. As such, the actuator assembly 1502 includes a base member 1504, a first member 1506, and a second member 1508. As with the above example embodiments, the base member 1504 supports the lower structure 1520, the upper structure 1522 is secured to and moves with the first member 1506, and the helm controls 1524 and the seat 1526 are secured to and move with the second member 1508. The actuator assembly 1502 is similarly configured to provide an infinite range of positions for the upper structure 1522, for the helm controls 1524, and for the seat 1526 from the stowed configuration to the raised configuration inclusive.

In this example embodiment, the helm cross bar 1530 is likewise connected to the second member 1508, but via a helm cross bar pivoting assembly 1532 configured to move from a helm cross bar first position (FIG. 15C) to a helm cross bar second position (FIG. 15D) which is relatively higher than the helm cross bar first position, and any position in between. The helm cross bar pivoting assembly 1532 does so while maintaining proper orientation of the helm controls 1524. In this example embodiment, the seat 1526 is likewise connected to the second member 1508, but via a cantilevered seat support arm 1534.

Figure 16A:
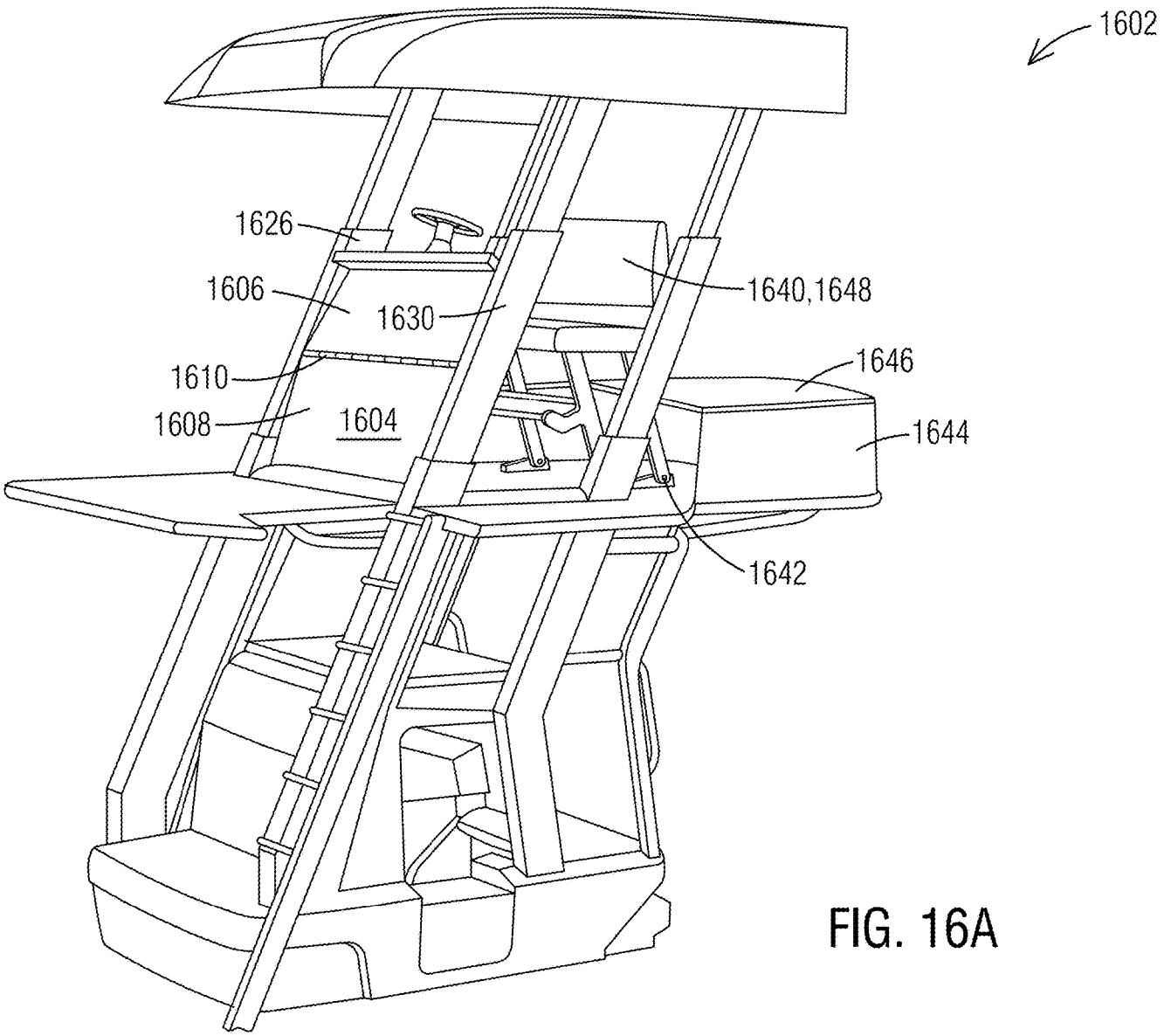
FIG. 16A to FIG. 16C show an alternate example embodiment of a compactible helm station assembly.
Figure 16B:
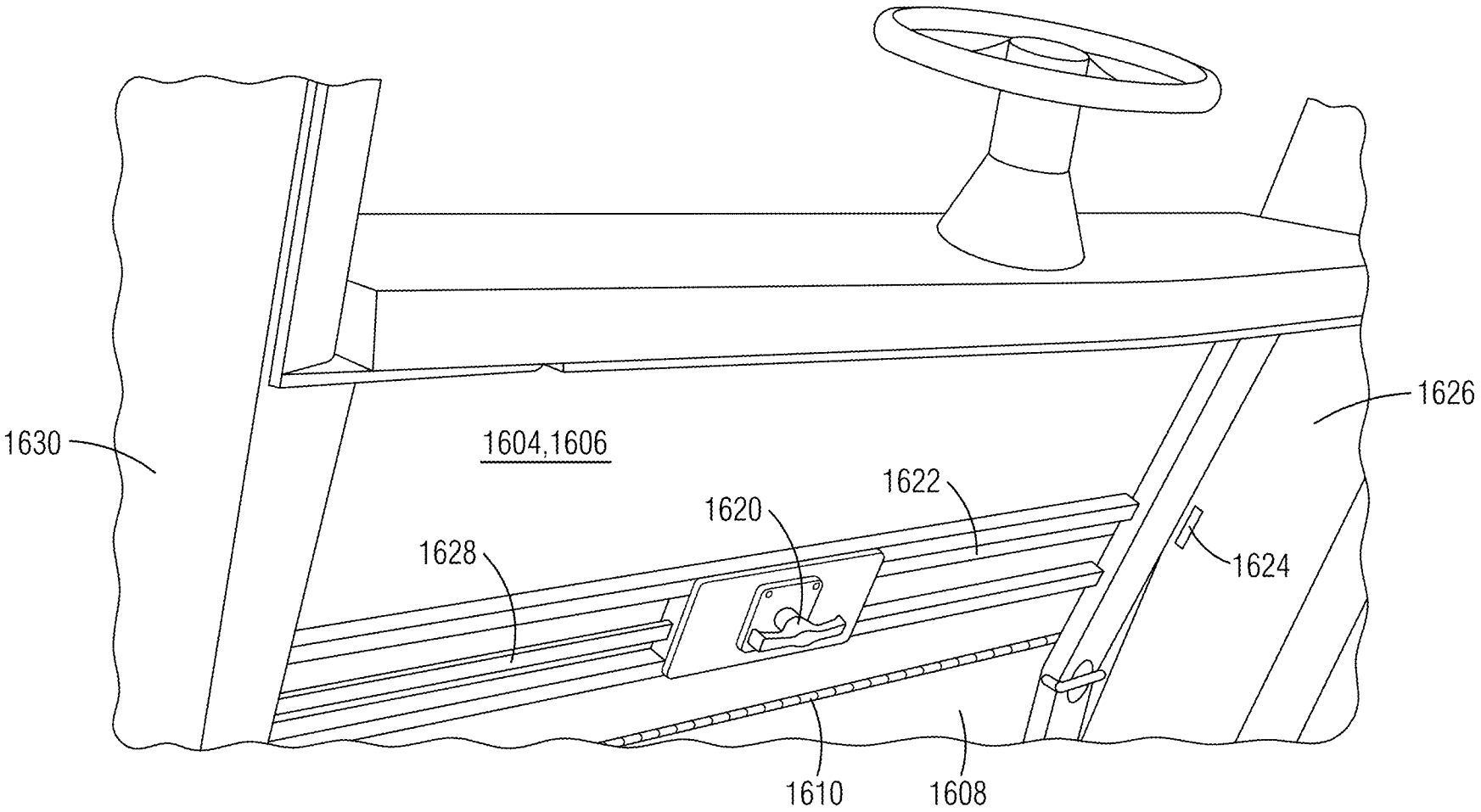
Figure 16C:
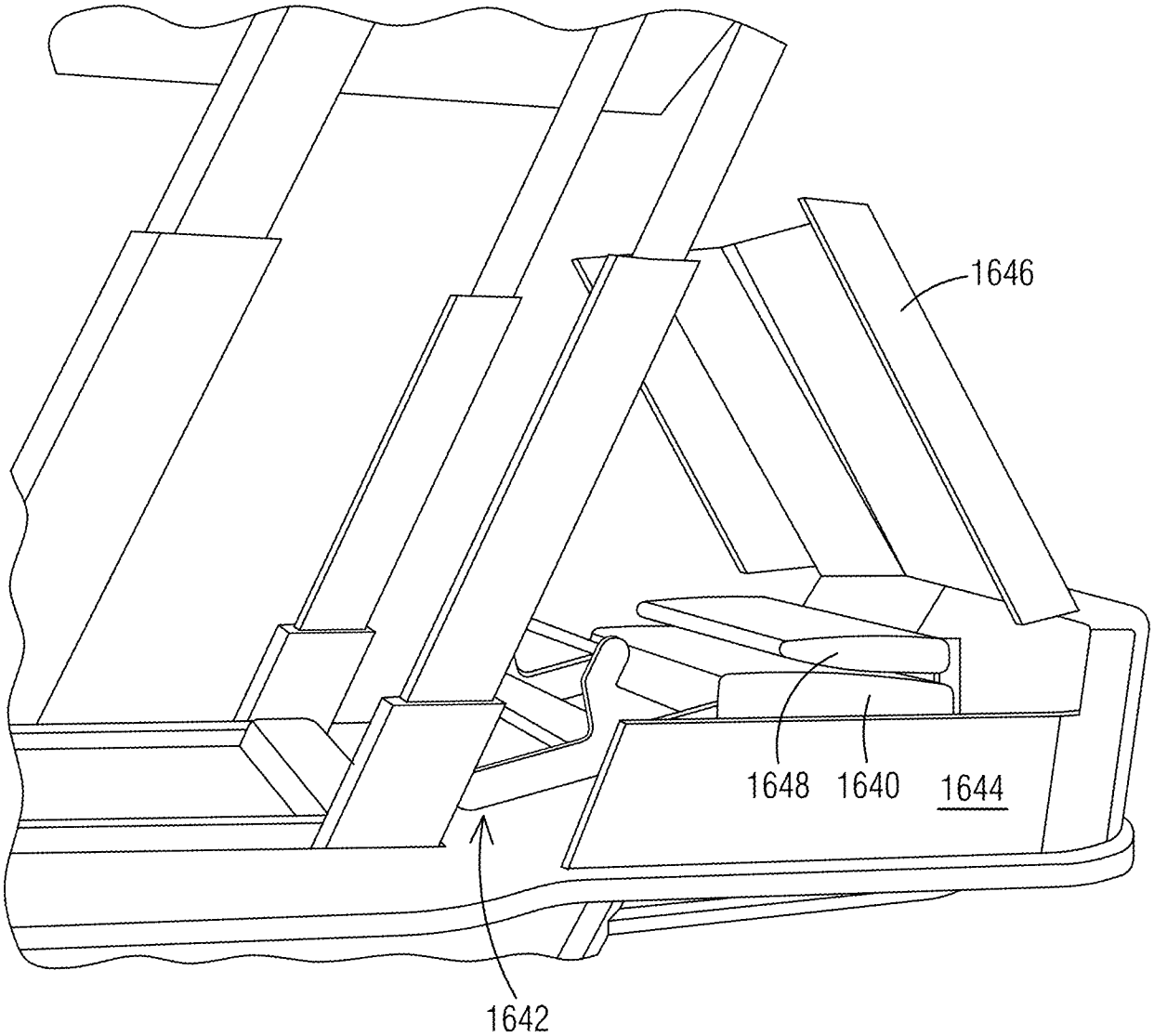

FIG. 16A to FIG. 16C show an alternate example embodiment of a compactible helm station assembly 1602. In this example embodiment, the structure panel 1604 includes an upper panel member 1606, a lower panel member 1608, and a hinge 1610 therebetween. When the compactible helm station assembly 1602 is in the stowed configuration, the upper panel member 1606 simply folds onto the lower panel member 1608. When the compactible helm station assembly 1602 moves from the stowed configuration to the raised configuration, the upper panel member 1606 and the lower panel member 1608 unfold. The upper panel member 1606 and the lower panel member 1608 can be locked in the unfolded position by turning a handle 1620 clockwise as seen in FIG. 16B. This causes an upper locking rod 1622 to move right into an upper locking rod slot 1624 in the right front member 1626 and a lower locking rod 1628 to move left into a lower locking rod slot (not visible) in the left front member 1630. The structure panel 1604 can be unlocked by simply turning the handle 1620 the opposite direction.

This example embodiment of the compactible helm station assembly 1602 further includes an elevated helm station seat 1640 shown in FIG. 16A in an unfolded/deployed configuration, and in FIG. 16C in a folded/stored configuration. The elevated helm station seat 1640 can be moved between the folded and unfolded configurations manually or via one or more actuators (linear, screw, hydraulic, pneumatic, electric, etc.). When in the folded configuration, the elevated helm station seat 1640 can be pivoted about pivot 1642 into and stored in a seat storage area 1644. The seat storage area 1644 may have an optional seat storage area lid 1646 that can be moved out of the way while the elevated helm station seat 1640 is moved between the folded configuration and the unfolded configuration. The elevated helm station seat 1640 may be vertically adjustable, adjustable fore and aft, and/or have a folding and adjustable bolster 1648 using mechanism known to the artisan.

Any of the actuators, pivot joints, and mechanisms etc. disclosed above can be fully manually activated, manual with an assist (e.g., spring or counterweight), or powered (electric, hydraulic, pneumatic etc.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Moreover, any of the actuators, pivot joints, and mechanisms etc. disclosed above can be fully manually activated, manual with an assist (e.g., spring or counterweight), or powered (electric, hydraulic, pneumatic etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

a lower structure configured to be a top of a lower area of a marine vessel; and an upper structure configured to be raised and lowered relative to the lower structure;

wherein when the apparatus is in a stowed configuration the lower structure and the upper structure combine to form an integrated top for the lower area; and wherein when the apparatus is in a raised configuration the apparatus creates an occupant station in which the lower structure is the top of the lower area and also a floor for the occupant station and the upper structure acts as a top for the occupant station;

an actuator assembly configured to raise and lower the upper structure, wherein the actuator assembly comprises a first member and a second member that both raise and lower relative to the lower structure to raise and lower the upper structure;

wherein the first member comprises four parallel first members comprising two front first members and two rear first members;

wherein the second member comprises four parallel second members comprising two front second members and two rear second members; and wherein the actuator assembly further comprises at least one actuator that extends the first member and the second member.

2. The apparatus of claim 1, wherein the occupant station comprises a helm station.

3. The apparatus of claim 1, wherein the lower area comprises a lower helm station.

4. The apparatus of claim 1, wherein the integrated top of the lower area comprises a T-top.

5. The apparatus of claim 1, wherein the occupant station comprises a helm station, wherein the helm station comprises a steering wheel, and wherein the steering wheel is disposed on a helm cross bar that spans the two front second members.

6. The apparatus of claim 1, wherein the occupant station comprises a seat, wherein the seat is disposed on a seat cross bar that spans the two rear second members, and wherein the seat cross bar is vertically adjustable along the two rear second members.

7. The apparatus of claim 1, wherein the occupant station comprises a structure panel configured to move between a structure panel stiffening position configured to stiffen the second member when the apparatus is in the raised configuration and a structure panel folded position suitable to enable the apparatus to be compacted into the stowed configuration.

8. The apparatus of claim 1, wherein the occupant station a support bracket configured to move between a support bracket stiffening position by bracing an end of the second member against the lower structure when the apparatus is in the raised configuration and a support bracket folded position when the apparatus is compacted into the stowed configuration.

9. The apparatus of claim 2, wherein the helm station comprises an electronic display disposed in the upper structure.

10. The apparatus of claim 2, wherein the helm station comprises a seat configured to be moved between a deployed configuration suitable for occupancy and a stored configuration in a seat storage area.

11. The apparatus of claim 1, wherein the actuator assembly further comprises an actuator base from which the first member and the second member extend, and wherein the actuator base is configured to support the lower structure over the lower area of the marine vessel.

12. An apparatus, comprising:

a lower structure configured to be a top of a lower area of a marine vessel;

an upper structure configured to be raised and lowered relative to the lower structure; and elevated helm station components disposed between the lower structure and the upper structure;

wherein when the apparatus is in a stowed configuration the lower structure and the upper structure together form an integrated top for the lower area and the elevated helm station components are stored in the integrated top; and wherein when the apparatus is in a raised configuration the lower structure forms the top of the lower area and the upper structure is raised relative to the lower structure to form a top for an elevated helm station comprising the elevated helm station components;

an actuator assembly configured to raise and lower the upper structure, wherein the actuator assembly comprises:

an actuator base configured to support the lower structure over the lower area of the marine vessel;

a first member and a second member that both raise and lower relative to the actuator base to raise and lower the upper structure, wherein the first member extends farther than the second member, and wherein the upper structure is secured to the first member; and at least one actuator that extends the first member and the second member.

13. The apparatus of claim 12, wherein the top of the lower area comprises a T-top and the lower area comprises a lower helm station.

14. The apparatus of claim 12, wherein the elevated helm station components expand vertically into the raised configuration as the upper structure is raised to the raised configuration.

15. The apparatus of claim 12, wherein the first member comprises plural parallel first members comprising two front first members and two rear first members;

wherein the second member comprises plural parallel second members comprising two front second members and two rear second members; and wherein the elevated helm station components comprise a steering wheel and a seat, wherein the steering wheel is disposed on a helm cross bar that spans the two front second members, and wherein the seat is disposed on a seat cross bar that spans the two rear second members.

16. The apparatus of claim 12, further comprising stiffening components configured to be unfolded and structurally reinforce the actuator assembly when the apparatus is in the raised configuration.

17. The apparatus of claim 12, wherein the elevated helm station comprises an electronic display disposed in the upper structure.

18. An apparatus, comprising:

a lower structure configured to be a top of a lower area of a marine vessel; and an upper structure configured to be raised and lowered relative to the lower structure;

wherein when the apparatus is in a stowed configuration the lower structure and the upper structure combine to form an integrated top for the lower area; and wherein when the apparatus is in a raised configuration the apparatus creates an occupant station in which the lower structure is the top of the lower area and also a floor for the occupant station and the upper structure acts as a top for the occupant station;

wherein the occupant station comprises a helm station; and wherein the helm station comprises a seat configured to be moved between a deployed configuration suitable for occupancy and a stored configuration in a seat storage area.

19. An apparatus, comprising:

a lower structure configured to be a top of a lower area of a marine vessel; and an upper structure configured to be raised and lowered relative to the lower structure;

wherein when the apparatus is in a stowed configuration the lower structure and the upper structure combine to form an integrated top for the lower area; and wherein when the apparatus is in a raised configuration the apparatus creates an occupant station in which the lower structure is the top of the lower area and also a floor for the occupant station and the upper structure acts as a top for the occupant station;

an actuator assembly configured to raise and lower the upper structure, wherein the actuator assembly comprises a first member and a second member that both raise and lower relative to the lower structure to raise and lower the upper structure; and wherein the actuator assembly further comprises an actuator base from which the first member and the second member extend, and wherein the actuator base is configured to support the lower structure over the lower area of the marine vessel.

* * * * *